US005898958A

United States Patent [19]

Hall

[11] Patent Number: 5,898,958

[45] Date of Patent: May 4, 1999

[54] CONTROL CIRCUIT FOR DELIVERING WATER AND AIR TO OUTLET JETS IN A WATER-FILLED POOL

[75] Inventor: Keith A. Hall, Bettendorf, Iowa

[73] Assignee: Quad Cities Automatic Pools, Inc., Bettendorf, Iowa

[21] Appl. No.: 08/958,168

[22] Filed: Oct. 27, 1997

[51] Int. Cl.[6] ..... A47K 3/00

[52] U.S. Cl. ..... 4/541.1; 4/541.4

[58] Field of Search ..... 4/541.1, 541.2, 4/541.3, 541.4, 541.5, 538, 546, 557

[56] References Cited

U.S. PATENT DOCUMENTS

| | | | |
|---|---|---|---|
| 4,726,080 | 2/1988 | Henkin et al. | 4/541.1 |
| 4,954,179 | 9/1990 | Franninge | 4/541.1 |
| 5,526,538 | 6/1996 | Rainwater | 4/541.1 |

*Primary Examiner*—David J. Walczak

*Attorney, Agent, or Firm*—Zarley,McKee,Thomte,Voorhees & Sease

[57] ABSTRACT

The present invention relates to a control circuit for a whirlpool bath or pool. The control circuit is used to deliver water and/or air to outlet jets in a water-filled pool such as is typically used for hydrotherapy massage. The control circuit includes a pool with a water compartment, a plurality of air jets and water jets in the pool and in communication with the compartment. A water pump connects to the water jets. A rotary valve is interposed between the water pump and the water jets. The rotary valve can be rotationally operated to sequentially provide water to the water jets. Thus, a pattern or a wave can be established from the water jets. An air pump is also provided and connected to the air jets by a manifold and a three-way valve. The manifold is connected to the water jets by a plurality of conduits. Check valves are provided to prevent water from getting into the air system. The three-way valve allows air to be supplied and drawn into the water jets by venturi action.

14 Claims, 2 Drawing Sheets

CONTROL CIRCUIT FOR DELIVERING WATER AND AIR TO OUTLET JETS IN A WATER-FILLED POOL

BACKGROUND OF THE INVENTION

The present invention relates to the field of whirlpool baths, pools, or spas filled with water. More particularly, this invention relates to a control circuit for delivering water and air to outlet jets in such structures.

Various whirlpool bath designs and control circuits are known in the art. Some of these devices pump water through jets directed toward the occupant or the water inside the tub. Other devices include separate auxiliary jets which allow air to be pumped into the water already in the tub to enhance the churning, bubbling sensation experienced by the user. However, greater agitation and therapeutic affect are possible if water and air could be pumped through the same jets. Furthermore, pulsation or wave effects are more soothing and beneficial to the user. Conventional devices have been unable to successfully meet these needs.

Therefore, a primary objective of the present invention is the provision of an improved control circuit for delivering water and air to outlet jets of a water-filled pool.

A further object of this invention is the provision of a spa control circuit that has few components, is simple, as well as easy and flexible, to operate.

A further object of this invention is the provision of a spa control circuit which is economical to produce, reliable and durable in use.

These and other objects will be apparent from the drawings, as well as from the description and claims which follow.

SUMMARY OF THE INVENTION

The present invention relates to a control circuit for a whirlpool bath or pool. The control circuit is used to deliver water and/or air to outlet jets in a water filled pool such as is typically used for hydrotherapy massage. The control circuit includes a pool with a water compartment, a plurality of air jets and water jets in the pool and in communication with the compartment. A water pump is connected to the water jets. An air pump is also provided and connected to the air jets by a manifold and a three-way valve. The manifold is connected to the water jets by a plurality of conduits. Each of the conduits has a check valve to prevent water from getting into the air system. Similarly, a check valve is also provided between the air pump and the air jets. A rotary valve is interposed between the water pump and the water jets. The rotary valve can be rotationally operated to sequentially provide water to the water jets. Thus, a pattern or a wave can be established from the water jets. Furthermore, the three-way valve allows air to be supplied and drawn into the water jets by venturi action.

The three-way valve can be set by the operator in one of three positions. In the first position, air from the air pump is only pumped to the air jets. In the second position, air from the air pump is delivered to the water jets and drawn thereinto by a venturi effect. In the third position, the air from the pump is delivered to both the air jets and the water jets.

Pool-side controls are provided to the user to turn the air pump off and on and stop or start the rotary valve in any position along its rotary path. Thus, the operator has control of the particular wave effect developed in the pool. An electronic microcontroller is also provided to further coordinate the operation of the pumps and the rotary valve.

DETAILED DESCRIPTION OF THE PREFERRED EMBODIMENT

Figure 1:
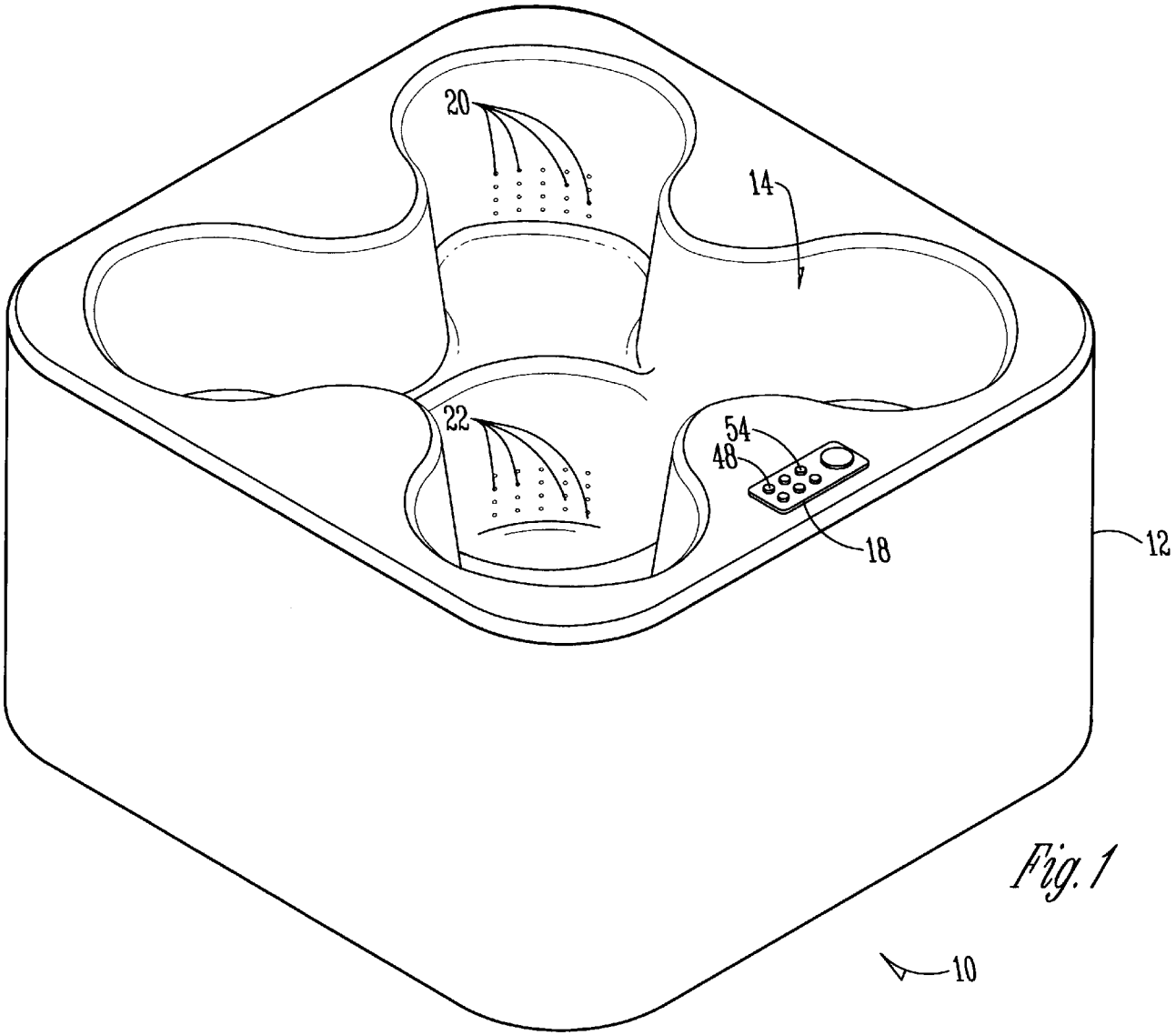
FIG. 1 is a perspective view of a whirlpool bath equipped with the control circuit of the present invention.

In the drawings and the description which follows, a whirlpool bath (or pool hereinafter, for short) is generally denoted by the reference numeral 10. In FIG. 1, the whirlpool bath 10 has a housing structure 12 which encloses and defines a cavity or compartment 14 for holding a fluid, preferably a liquid such as water 16 (See FIG. 2). A control panel 18 is provided near the compartment 14 within the reach of the pool users.

Figure 2:
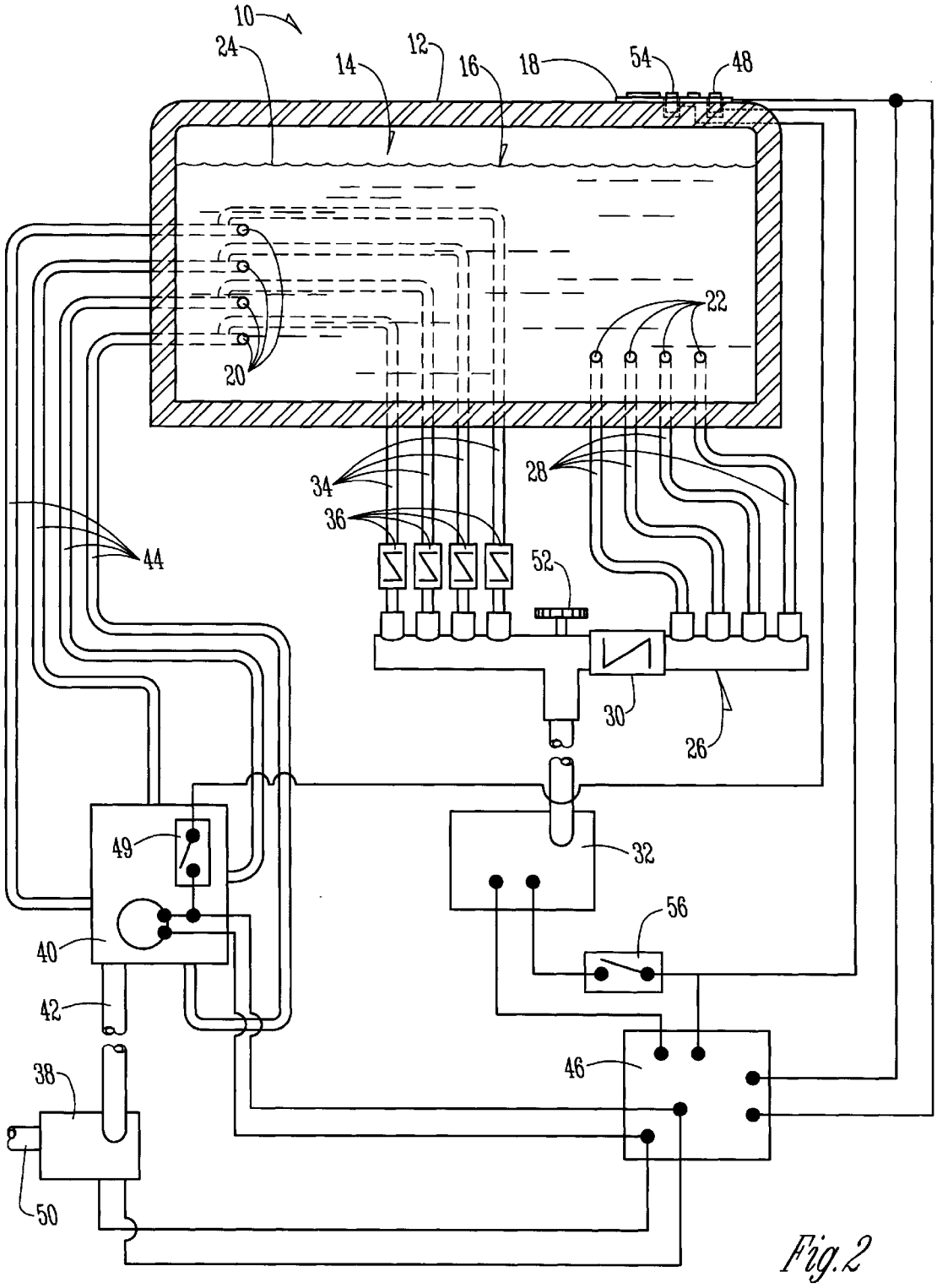
FIG. 2 is a pictorial schematic diagram illustrating the control circuit of the present invention. A vertical cross section of the pool is included.

In FIG. 2, the pool 10 is shown with its housing structure 12 in cross section. The housing structure 12 of the pool 10 has a plurality of water jets 20 therein which are in communication with the water compartment 14.

A plurality of air jets 22 are also included in the pool 10 and are in communication with the compartment 14. Preferably, a water level 24 should be maintained so that the water jets 20 and the air jets 22 are disposed near or below the water level 24 when the user(s) are seated in the pool 10. The air jets 22 are connected to an elongated manifold 26 by a plurality of corresponding conduits 28. The conduits 28 are connected to one portion or end of the manifold 26. A check valve 30 in the manifold 26 upstream of the conduits 28 prevents fluid from flowing in the direction of an air pump 32. The air pump 32 is a 2-speed pump. The user can shift from high speed to low speed to effectively reduce the mixing of air in the water jets 20 and thereby reduce the overall level of agitation and wave action within the pool 10.

A plurality of conduits 34 connect to the other portion or end of the manifold 26. Each of the conduits 34 includes a check valve 36 for preventing fluid from flowing from the conduits 34 into the manifold 26, in other words, towards the air pump 32. The conduits 34 extend through the housing structure 12 and fluidly connect with the water jets 20 just upstream of their discharge into the water compartment 14.

A water pump 38 is connected to a rotary valve 40 through a pipe 42. The water pump 38 is driven by conventional means (not shown). The rotary valve 40 selectively connects the water jets 20 to the water pump 38 through conduits 44. As mentioned above, the conduits 44 are joined by the conduits 34 at the water jets 20. Specifically, the connection of the conduits 34 to the water jets 20 provides a venturi action or effect whereby air will be mixed with the water as it is expelled from the water jet 20. The rotary valve 40 is a 220 volt motorized valve. The stationary portion of the rotary valve 40 has a plurality of outlets which are aligned with the conduits 44. The rotary portion of the valve 40 is driven or rotated to selectively align with the outlets. The rotary portion of the valve 40 covers or uncovers the various outlets depending on its angular position. The water pump 38, the rotary valve 40 and the air pump 32 are connected to an electronic controller 46, preferably an electronic microcontroller. The controller 46 selectively actuates them.

Furthermore, the rotary valve 40 can be remotely started or stopped by pressing a water-resistant air button 48 on the control panel 18. See FIG. 1. The air button 48 is of the watertight or at least water-resistant type and actuates a switch 49 (FIG. 2) which allows the operator to start and stop the rotary valve 40 in any position. A return line or inlet 50 provides water 16 from the compartment 14 or other source of water (not shown). A switch and air button arrangement is also provided for controlling the air pump 32. As seen in FIG. 1, an air button 54 is provided on control panel 18. A switch 56 (FIG. 2) responds to the air button 54 and stops or starts the air pump 32 accordingly. The air pump 32 can be equipped with an automatic shut off through the controller 46.

A three-way valve 52 operatively interposed between the conduits 28 and 34 at the manifold 26 allows the air from the pump 32 to be directed to the conduits 28, the conduits 34, or both, depending on its position. The valve 52 is shown to be a manually operated valve in the preferred embodiment, however, an electrical or hydraulic valve would not detract from the invention. It is contemplated that the valve 52 could be automatically controlled by the controller 46.

Optionally, a timer can be included in the controller 46 so that the power to the water pump 38, rotary valve 40 and air pump 32 can be interrupted separately or in various combinations to achieve the desired results within the pool 10. For instance, power could be withdrawn from the water pump 38 and the air pump 32 at given intervals, such as approximately every 20 minutes. This would conserve energy and encourage users not to stay too long in the pool 10.

In operation, the pool 10 is filled with water 16 until the water level 24 is above the jets 20 and 22 when the user(s) are seated in the pool 10. Generally, the user will actuate the water pump 38 and the rotary valve 40 first. This causes water to be routed through one or more of the conduits 44 to the water jets 20. Through a venturi affect, the water jets 20 draw a small amount of air through the conduits 34, even though the air pump 32 may be off. Using the air button 48 and the switch 49, the user can position the rotary valve 40 so that water is routed to particular jets 20 as desired. The controller 46 could actuate the switch 49 in a pattern to produce a flowing rhythm or wave of water through the jets 20. Thus, the control circuit of this invention can provide a therapeutic massaging effect for the user.

The water jets 20 can be arranged in various patterns. For instance, one pattern might include four horizontal rows of five jets 20 each. When the rotary valve 40 is allowed to rotate freely, the four horizontal rows of jets 20 disperse water in a sequential pattern as the motorized valve 40 sends water to each of the four rows of jets sequentially. As the rotary valve 40 causes the water to move from one row of jets to the next row, it creates a therapeutic effect on the particular area of the user's body that is disposed immediately in front of the jets. The water displaced by the respective jets 20 creates a soothing and rhythmic wave effect in the pool 10.

When the user desires greater cavitation and wave effect, the air button 54 is pushed to actuate the switch 56, which turns the air pump 32 on. The user can turn the three-way valve 52 so that air from the air pump 32 is delivered to the air jets 22. If enhanced cavitation and wave effect is desired in the pool 10, the user turns the three-way valve 52 to a second position in which air is routed through the conduits 34 to the water jets 20. The air is pumped to the jets 20 and drawn in by venturi effect. The air is expelled with the water through the water jets 20, which causes increased cavitation and movement in the water 16 at the exit of the jets 20. The user can also set the three-way valve 52 in a third position which routes air to both the air jets 22 and the water jets 20. The check valves 30 and 36 prevent water from being drawn back into the system through the water jets 20 or the air jets 22.

The user has a great deal of control over the output of the jets 20, 22. The control panel 18 provides the user with options to control the position and operation of the rotary valve 40 through the air button 48 and switch 49. Furthermore, the operator can control the air pump 32 through the air button 54 and switch 56. Thus, the user has at least two options for controlling the flow of water, air, and a combination of both into the pool 10. The switches 48 and 54 can be depressed at intervals or intermittently to achieve the desired pulsating wave effects. The present invention provides a flexible hydrotherapy massage system which the user can effectively customize to meet his or her own particular needs.

Therefore, it can be seen that the present invention at least achieves its stated objectives.

What is claimed is:

1. A control circuit for selectively delivering water and air to outlet jets in a water-filled pool, comprising:

a pool having a water compartment;

a plurality of air jets and water jets in the pool and in communication with the compartment;

a water pump selectively connected to the water jets through a first pipe and a rotary valve having a plurality of radially spaced outlets corresponding to and being connected respectively to the water jets;

an air pump selectively connectable to the air jets and the water jets through a manifold including one portion connected to the air jets and another portion connected to the water jets; and a selector valve being operatively interposed between the air pump and the portion of the manifold connected to the air jets and the another portion connected to the water jets; the selector valve selectively providing connection of the air pump to only the air jets, to only the water jets, and to both the air jets and water jets simultaneously.

2. The control circuit of claim 1 further comprising an electronic controller connected to the water pump, the air pump, the rotary valve, and first and second switches operably associated with the rotary valve and the air pump respectively, whereby the pumps and the rotary valve can be independently operated and the rotary valve can be actuated by the first switch and thereby rotationally operated to sequentially provide water to the respective water jets through the corresponding outlets as the rotary valve rotates, and the second switch can be opened or closed to selectively supply air to the manifold.

3. The control circuit of claim 2 further comprising a control panel for operator input which is located adjacent the water compartment and operatively connected to the electronic controller, the first switch, and the second switch.

4. The device of claim 1 wherein a check valve is located in the manifold upstream of the air jets in order to prevent flow of fluid in a direction towards said air pump.

5. The device of claim 1 wherein a check valve is located between the water jets and the air pump in order to prevent flow of fluid in a direction towards said air pump.

6. The device of claim 5 wherein a plurality of conduits respectively connect the air pump to the water jets, each of the conduits including a check valve therein.

7. The control circuit of claim 1 wherein the selector valve is a three-way hand turnable valve.

8. A control circuit for delivering water and air to outlet jets in a water filled pool, comprising:

a pool having a water compartment;

a plurality of air jets and water jets in said pool and in communication with said compartment;

a water pump selectively connected to the water jets through a first pipe and a rotary valve having a plurality of radially spaced outlets corresponding to and being connected respectively to the water jets;

an air pump selectively connectable to the air jets and the water jets through a manifold including one end connected to the air jets and another end connected to the water jets;

a selector valve being operatively disposed between the air pump and the ends of the manifold for selectively connecting the air pump to only the air jets, to only the water jets, and to both the air jets and water jets simultaneously; and control means for driving the air and water pumps and for depriving said pumps from electric power at preselected intervals of time to affect water turbulence in the water compartment adjacent the air and water jets.

9. The control circuit of claim 8 wherein the control means comprises a water-resistant air button located adjacent the water compartment and operably connected to a switch for selectively disconnecting the air pump from a source of electrical power.

10. The control circuit of claim 8 wherein the control means comprises an air button located adjacent the water compartment and connected to the air pump.

11. The control circuit of claim 8 wherein the control means comprises a switch connected to the rotary valve for selectively disconnecting the water pump from the water jets.

12. The control circuit of claim 8 wherein the control means comprises an air button located adjacent the water compartment and operably connected to a switch for selectively disconnecting the water pump from a source of electrical power.

13. The control circuit of claim 8 wherein the control means comprises an electronic microcontroller connected to a pool-side operator control panel located adjacent the water compartment and having a plurality of air buttons thereon, the air buttons being operably connected to first and second switches associated with the water pump and the air pump respectively and to the microcontroller, the microcontroller being connected the rotary valve, the water pump, the air pump.

14. The control circuit of claim 8 wherein each of the water jets has an outlet into the water compartment and the outlet is connectable to the air pump through the manifold and a conduit, the conduit being connected to the manifold and to the water jet adjacent to and upstream of the outlet so as to draw air in the conduit into the water jet by venturi action.

* * * * *